United States Patent [19]

Smith et al.

[11] 4,157,875

[45] Jun. 12, 1979

[54] BINDER FOR COMPUTER PRINTOUT

[75] Inventors: Gertrude Smith; Joe D. Giulie, both of Palo Alto, Calif.

[73] Assignee: Devoke Company, Palo Alto, Calif.

[21] Appl. No.: 851,952

[22] Filed: Nov. 16, 1977

[51] Int. Cl.[2] ..... B42F 3/00; B42F 15/04

[52] U.S. Cl. ..... 402/4; 281/15 A; 281/35; 312/184

[58] Field of Search ..... 402/4, 70, 73, 74; 281/15 A, 15 R, 29, 35; 312/183, 184

[56] References Cited

U.S. PATENT DOCUMENTS

| | | | |
|---|---|---|---|
| 956,861 | 5/1910 | Levey | 281/15 R |
| 3,801,175 | 4/1974 | Giulie | 312/184 |
| 3,885,726 | 5/1975 | Fridlund et al. | 312/184 X |

FOREIGN PATENT DOCUMENTS

| | | | |
|---|---|---|---|
| 1806521 | 8/1969 | Fed. Rep. of Germany | 402/73 |
| 1536691 | 1/1970 | Fed. Rep. of Germany | 402/4 |
| 2227564 | 12/1973 | Fed. Rep. of Germany | 402/74 |

*Primary Examiner*—Willie G. Abercrombie
*Attorney, Agent, or Firm*—Robert G. Slick

[57] ABSTRACT

A binder for computer printout sheets is provided, said binder having front and back covers for the computer printout sheets which can be folded over into a compact form. Preferably the binder has hooks extending at each end thereof to enable the binder to be hooked over a file drawer or the like.

4 Claims, 4 Drawing Figures

BINDER FOR COMPUTER PRINTOUT

SUMMARY OF THE INVENTION

Computer printout sheets are somewhat difficult to handle and store. A typical printout consists of an extended web 14¾ inches wide with perforations every 11 inches. The web goes through a burster mechanism which tears the web on the perforations, leaving sheets 14¾ inches wide by 11 inches high. Such sheets will not fit into an ordinary ring binder and cannot be stored in ordinary letter-size file drawers. Accordingly, such sheets present a problem for the small business to handle and store.

In accordance with the present invention, a binder is provided which has front and back covers which will cover the normal computer printout sheet. The back cover is longer than the front cover and both covers have a flexible portion near the middle, so that a filled binder can be folded upon itself to reduce the size to about half. Further, Velcro strips are provided, as is later explained in detail, to hold the folded-over binder together.

A further advantage of the present invention is that such computer sheets will ordinarily not fit into the usual attache or briefcase and the binder of the present invention permits such sheets to be easily carried in even the smallest briefcase.

In a preferred embodiment of the invention, the binder is also provided with hooks which extend from either side of the spine which holds the sheets so that the binder in its folded condition can be hung in an ordinary letter-size file drawer. Thus, the large computer sheets can be handled as conveniently as ordinary letter-size files.

Various other features and advantages of the invention will be brought out in the balance of the specification.

BRIEF DESCRIPTION OF THE DRAWINGS

FIG. 4 is a perspective view showing how the binder of the present invention can be hung in a file drawer or the like.

DESCRIPTION OF THE PREFERRED EMBODIMENTS

Figure 1:
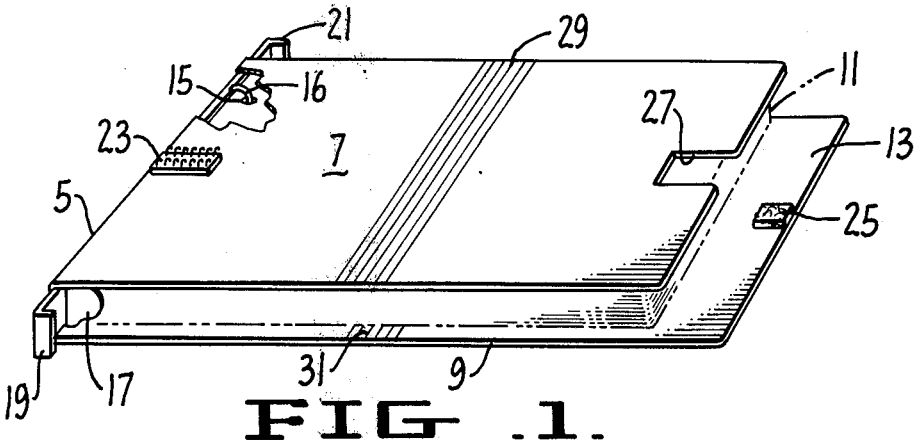
FIG. 1 is a perspective view of a binder embodying the present invention.

Referring now to the drawings by reference characters, the binder of the present invention includes a spine 5 having a front cover 7 and a back cover 9 extending outwardly therefrom. The front cover is substantially equal in width to the width of computer printout sheets 11 contained within the binder. The rear cover 9 extends some distance beyond the width of the sheets, as is shown at 13, for reasons which will be later apparent. The spine 5 has means attached thereto for retaining the sheets and this can take the form of the familiar split rings 15 passing through holes 16 in sheets 11 which are commonly used in ring binders. Such ring binders are ordinarily provided with a lever 17 for releasing the rings. In accordance with a preferred embodiment of the invention, the spine has hooks 19 and 21 attached to either end thereof, the function of which will be later explained.

Figure 2:
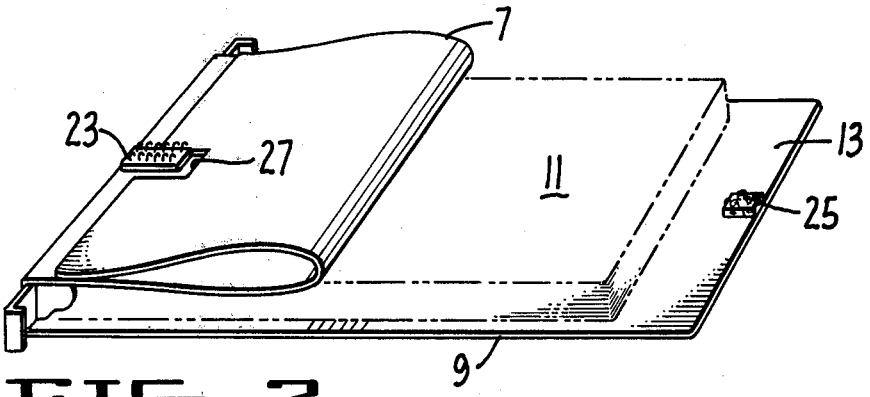
FIG. 2 is a similar perspective view showing the binder with the front cover folded back.

On the outer surface near the center and adjacent to the spine of the front cover 7 is placed a small piece of Velcro® designated 23. A mating piece of Velcro 25 is placed near the center of the inside distal edge of the back cover 13. The front cover has near the center of the distal edge a cut-out 27 corresponding in size and shape to the Velcro 23. Thus, when the front cover is folded back upon itself, as is shown in FIG. 2, the Velcro 23 is exposed.

The front and back covers 7 and 9 may be made of a soft, easily-bendable plastic material or they can be made of a relatively stiff plastic with a series of creases 29 and 31. Creases 29 and 31 enable the front and back covers to bend easily near the center of the printout sheets.

Figure 3:
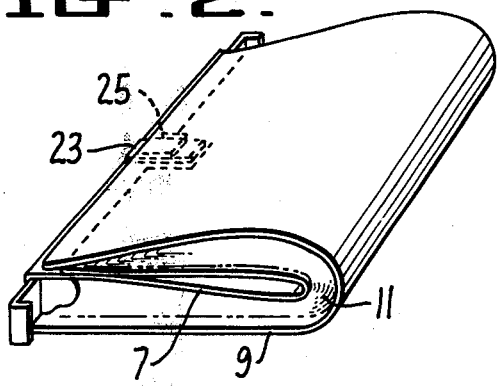
FIG. 3 is a perspective view showing the binder in the folded position.

In use, the computer printout sheets 11 would be fastened into the binder in the usual manner. The contents are easy to use and it is only necessary to turn back the front cover 7 to use the sheets in the usual manner. If one wishes to store the filled binder, it is only necessary to fold over the front and back covers, carrying the computer sheets along, whereupon Velcro 23 will engage the Velcro 25 producing the compact structure shown in FIG. 3. In this form, it is easy to carry the package of binder sheets in a briefcase or the like.

Figure 4:
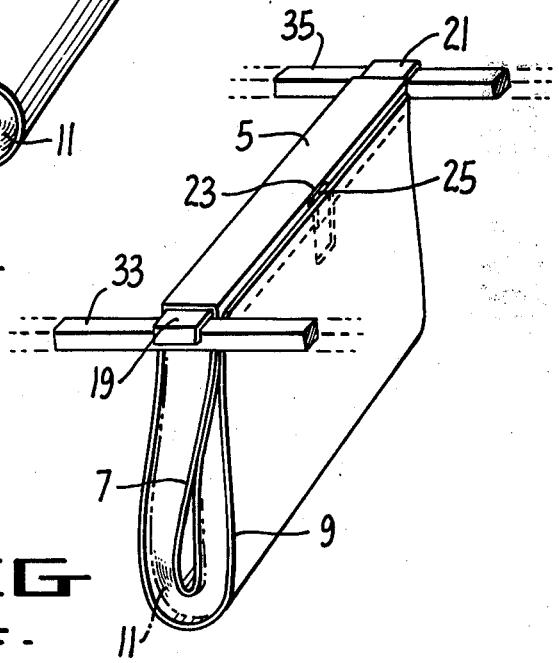

In FIG. 4, it is shown how the hooks 19 and 21 enable one to hang the filled binder on the edges 33 and 35 of a file drawer or similar structure having parallel rails.

Many variations can be made in the exact structure shown without departing from the spirit of this invention. For instance, a single piece of Velcro has been shown on the front cover and the back cover, but it is obvious that more than one piece can be used, e.g. at the top and the bottom rather than the center of the binder. Further, it is not necessary that the notch 27 be employed, but instead the proportions of the front and back covers can be such that in the folded condition, the back cover will extend beyond the front cover for a sufficient distance that the Velcro pieces can be engaged. Further, instead of pieces of Velcro, one could use a strip running substantially the length of the spine on the proximal edge of the front cover and the distal edge of the back cover.

We claim:

1. A binder for computer printout sheets or the like comprising in combination:

a. a spine having a length approximately equal to the height of a sheet, b. retaining means mounted on said spine adapted to engage mating holes in said sheets, c. front and back cover members attached to and extending outwardly from said spine, each cover having a flexible center portion, d. said front cover member being about the width of a sheet and said back cover member extending beyond the width of a sheet, e. a notch in said front cover, f. a first piece of Velcro on the outside surface of the front cover adjacent to the spine, said Velcro being located opposite said notch whereby when said front cover is folded back upon itself, said Velcro will extend through the notch, g. a complementary piece of Velcro on the inner surface of the back cover, said Velcro on the back cover being positioned in line with said notch on the front cover, whereby h. said back cover can be folded over said sheets and said front cover folded back to engage the two Velcro pieces.

2. The binder of claim 1 wherein said front and back covers each have a single piece of Velcro near the center thereof.

3. The binder of claim 1 having hooks extending on each end of the spine whereby the binder can be hooked over the edges of a file drawer.

4. The binder of claim 1 wherein the retaining means comprises a plurality of binder rings.

* * * * *